US007731526B2

(12) United States Patent
Sato

(10) Patent No.: US 7,731,526 B2
(45) Date of Patent: Jun. 8, 2010

(54) ELECTRICAL CONNECTOR HAVING CONTACTS WITH CONTACT PORTIONS ARRANGED IN THREE CONTACT PORTION TIERS

(75) Inventor: Yukiko Sato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/322,921

(22) Filed: Feb. 9, 2009

(65) Prior Publication Data

US 2009/0209132 A1 Aug. 20, 2009

(30) Foreign Application Priority Data

Feb. 19, 2008 (JP) ..... 2008-037058

(51) Int. Cl.
*H01R 13/66* (2006.01)
*H01R 12/00* (2006.01)

(52) U.S. Cl. ..... 439/541.5; 439/60

(58) Field of Classification Search ..... 439/541.5, 439/60, 542, 83, 637; 361/119
See application file for complete search history.

(56) References Cited

U.S. PATENT DOCUMENTS

| | | | | |
|---|---|---|---|---|
| 4,298,237 | A * | 11/1981 | Griffith et al. | 439/60 |
| 5,199,886 | A * | 4/1993 | Patterson | 439/79 |
| 5,472,349 | A * | 12/1995 | Dixon et al. | 439/79 |
| 5,785,537 | A * | 7/1998 | Donahue et al. | 439/79 |
| 6,811,429 | B2 * | 11/2004 | Recktenwald et al. | 439/405 |

FOREIGN PATENT DOCUMENTS

| | | |
|---|---|---|
| JP | 47-014869 | 10/1972 |
| JP | 04-036789 | 3/1992 |
| JP | 7-335343 | 12/1995 |
| JP | 2007-115707 | 5/2007 |

OTHER PUBLICATIONS

Japanese Office Action issued Jan. 13, 2010 in JP application No. 2008-037058 and English translation of relevant part of same.

* cited by examiner

*Primary Examiner*—Chandrika Prasad
(74) *Attorney, Agent, or Firm*—Collard & Roe, P.C.

(57) ABSTRACT

The terminal portions 222*a*, 222*b* of the contacts having the contact portions 221*a*, 221*b* belonging to (2n/2)-th contact portion tier 2-21 are arranged so as to be alternately allocated to the first terminal portion tier 1-22 and the second terminal portion tier 2-22.

4 Claims, 4 Drawing Sheets

ELECTRICAL CONNECTOR HAVING CONTACTS WITH CONTACT PORTIONS ARRANGED IN THREE CONTACT PORTION TIERS

This application is based on and claims the benefit of priority from Japanese Patent Application No. 2008-37058, filed on Feb. 19, 2008, the disclosure of which is incorporated herein in its entirety by reference.

BACKGROUND OF THE INVENTION

This invention relates to an electrical connector and, in particular, relates to an electrical connector having an insulator and a plurality of contacts arranged in line in the width direction of the insulator, wherein the contacts each have a contact portion contactable with a first connection object such as a mating connector and a terminal portion adapted to be fixedly connected to a second connection object such as a printed circuit board.

As this type of electrical connector, there is one in which contact portions of a plurality of contacts are arranged in a plurality of contact portion tiers superposed in the vertical direction (height direction) of an insulator (housing), while, terminal portions of the contacts having the contact portions belonging to (arranged or located in) the respective contact portion tiers are arranged so as to be allocated to one or the other of two terminal portion tiers superposed in the vertical direction of the insulator.

Such an electrical connector is disclosed, for example, in Japanese Unexamined Patent Application Publication (JP-A) No. H7-335343. This publication discloses an electrical connector in which contact portions of a plurality of contacts are arranged in first to fourth contact portion tiers superposed in the vertical direction perpendicular to the width direction of an insulator. In this electrical connector, terminal portions of the contacts having the contact portions belonging to the first contact portion tier and terminal portions of the contacts having the contact portions belonging to the second contact portion tier are arranged in a first terminal portion tier, while, terminal portions of the contacts having the contact portions belonging to the third contact portion tier and terminal portions of the contacts having the contact portions belonging to the fourth contact portion tier are arranged in a second terminal portion tier.

In an electrical connector having an even number of contact portion tiers like the above electrical connector, terminal portions of contacts can be allocated to two terminal portion tiers in a balanced manner.

On the other hand, in an electrical connector having an odd number of contact portion tiers, terminal portions of contacts having contact portions belonging to the middle contact portion tier (e.g. the second contact portion tier when the total number of contact portion tiers is three or the third contact portion tier when the total number of contact portion tiers is five) are allocated to only one of a first terminal portion tier and a second terminal portion tier. Therefore, one of the terminal portion tiers has a greater number of terminal portions than the other terminal portion tier. This difference in number of terminal portions causes a difference in size between occupation spaces of both terminal portion tiers, particularly in the width direction of the electrical connector. Since the occupation space of the entire electrical connector depends on the terminal portion tier having the larger occupation space, it inevitably becomes large in size. This is disadvantageous for miniaturization of the electrical connector.

Further, in an electrical connector of the type adapted to sandwich a plate-shaped second connection object such as a printed circuit board between both terminal portion tiers thereof, the number of terminal portions for connection to one of plate surfaces of the second connection object becomes greater than that of terminal portions for connection to the other plate surface. Therefore, the stability of the electrical connector with respect to the second connection object is poor so that there is a possibility that the electrical connector is inclined in temporary fixing before soldering the terminal portions so as to be offset from the correct position and, after soldering the terminal portions, unwanted stress is applied to the soldered portions.

SUMMARY OF THE INVENTION

It is therefore an object of this invention to provide an electrical connector, having contacts in which contact portions are arranged in an odd number of contact portion tiers, small in occupancy space, free from positinal deviation during mounting operation on a connection object, and free from generation of unwanted stress after mounting thereon.

According to this invention, there is provided an electrical connector comprising an insulator and a plurality of contacts arranged in line in a width direction of said insulator, wherein said contacts have a contact portion adapted to be detachably connected to a first connection object and a terminal portion adapted to be fixedly connected to a second connection object, respectively; said contact portions of said contacts are arranged in first to (2n−1)-th contact portion tiers superposed in a vertical direction perpendicular to the width direction of said insulator, the variable n being an integer no less than 2, said terminal portions of the contacts having the contact portions belonging to the first to ((2n/2)−1)-th contact portion tiers are arranged in a first terminal portion tier of the first and second terminal portion tiers superposed in the vertical direction of the insulator, the terminal portions of the contacts having the contact portions belonging to ((2n/2)+1)-th to the (2n−1)-th contact portion tiers are arranged in the second terminal portion tier, and the terminal portions of the contacts having the contact portions belonging to (2n/2)-th contact portion tier are arranged so as to be alternately allocated to the first terminal portion tier and the second terminal portion tier.

The contacts having the contact portions belonging to (n−m)-th contact portion tier and the contacts having the contact portions belonging to (n+m)-th contact portion tier may be same in shape, the variable m being an integer no less than 1 and less than n. The contacts having the contact portions belonging to the (2n/2)-th contact portion tier may be same in shape.

The second connection object may have a plate-like shape. The first and the second terminal portion tiers may be fixedly connected to first and second plate surfaces of the second connection object, respectively.

The contacts may have elasticity. The first and second terminal portion tiers may press against the first and the second plate surfaces of the second connection object, respectively, so as to hold therebetween the second connection object in the vertical direction.

Other objects and advantages of this invention will become clear as the description proceeds.

DESCRIPTION OF THE PREFERRED EMBODIMENT

Hereinbelow, an electrical connector according to an embodiment of this invention will be described with reference to the drawings.

Referring to FIGS. 1A and 1B, FIGS. 2A to 2D, FIG. 3, and FIG. 4, the present electrical connector comprises an insulator (housing) 10 made of an insulating material, a plurality of metal contacts arranged in line in a width direction W of the insulator 10, and a metal shell 30 covering the insulator 10.

Figure 4:
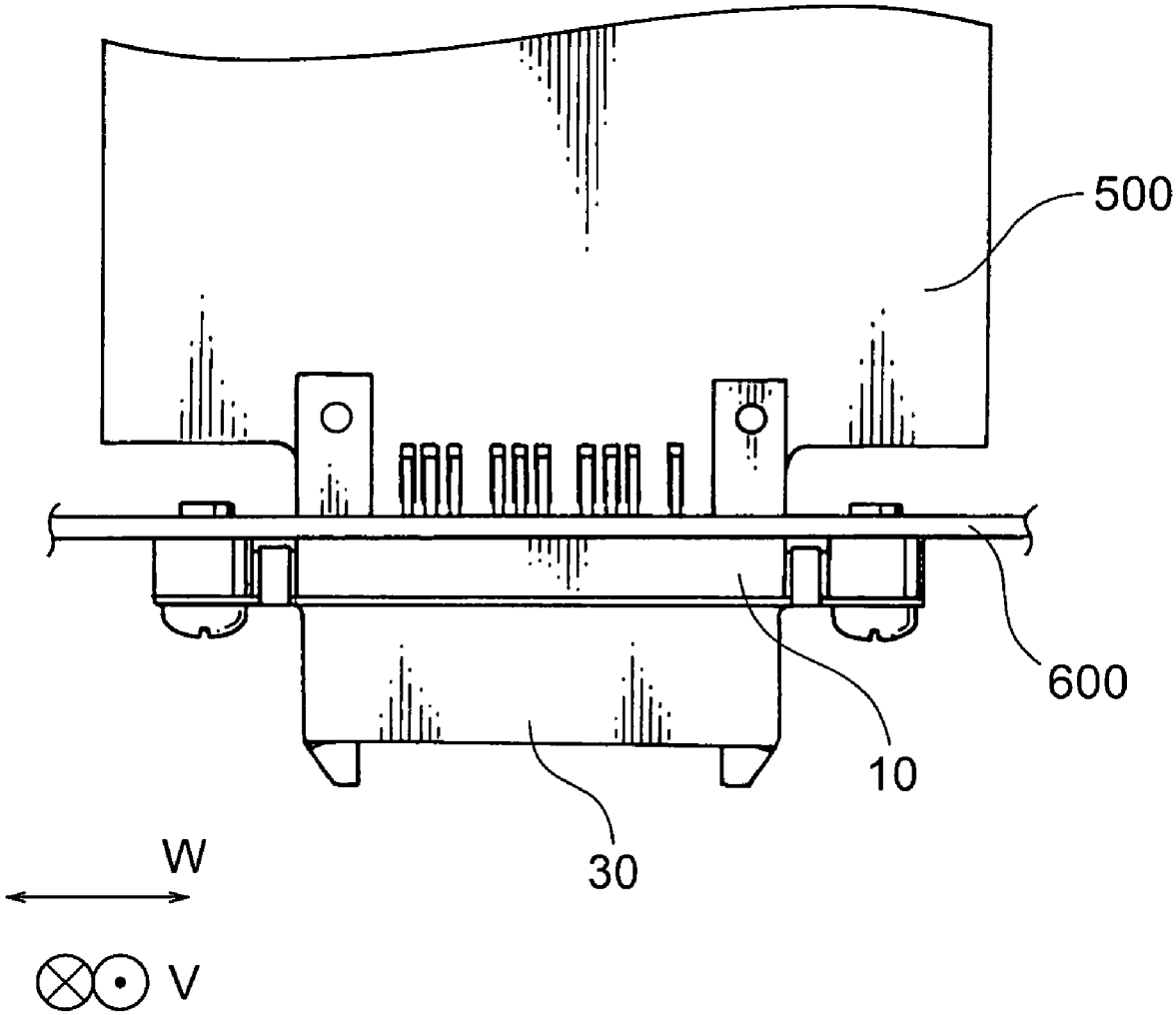
FIG. 4 is a top view in which the electrical connector illustrated in FIGS. 1A and 1B is attached to a printed circuit board.

The contacts respectively have contact portions 121, 221*a* and 221*b*, and 321 adapted to be detachably connected to a first connection object such as a non-illustrated mating connector and terminal portions 122, 222*a* and 222*b*, and 322 adapted to be soldered to pads or lands of a printed circuit board 500 (illustrated only in FIG. 4) as a second connection object. In FIG. 4, symbol 600 denotes a part or a panel of a housing of an electronic device or an electronic module having the printed circuit board 500.

The contact portions of the contacts are arranged in first to (2n−1)-th (n is an integer of 2 or more) contact portion tiers superposed in order in a vertical direction V perpendicular to the width direction W of the insulator 10. That is, the contact portions of the contacts are arranged in an odd number (=3 or more) of contact portion tiers. In this embodiment, n is set to 2 so that the contact portions of the contacts are arranged in three contact portion tiers, i.e. first, second, and third contact portion tiers 1-21, 2-21, and 3-21.

The terminal portions 122 of the seven contacts having the contact portions 121 belonging to (arranged or located in) the first to ((2n/2)−1)-th contact portion tier/tiers being the first half of the odd number (=3 or more) of contact portion tiers, i.e. belonging to the first contact portion tier 1-21 in this embodiment, are arranged in a first terminal portion tier 1-22 of first and second terminal portion tiers 1-22 and 2-22 stacked in the vertical direction V of the insulator 10.

On the other hand, the terminal portions 322 of the seven contacts having the contact portions 321 belonging to the ((2n/2)+1)-th to (2n−1)-th contact portion tier/tiers being the second half of the odd number (=3 or more) of contact portion tiers, i.e. belonging to the third contact portion tier 3-21 in this embodiment, are arranged in the second terminal portion tier 2-22.

Further, the terminal portions 222*a* of the three contacts having the contact portions 221*a* and the terminal portions 222*b* of the three contacts having the contact portions 221*b*, belonging to the (2n/2)-th contact portion tier being the middle tier of the odd number (=3 or more) of contact portion tiers, i.e. belonging to the second contact portion tier 2-21 in this embodiment, are arranged so as to be alternately allocated to the first terminal portion tier 1-22 and the second terminal portion tier 2-22 in order of arrangement in the width direction W of the insulator 10.

Figure 1B:
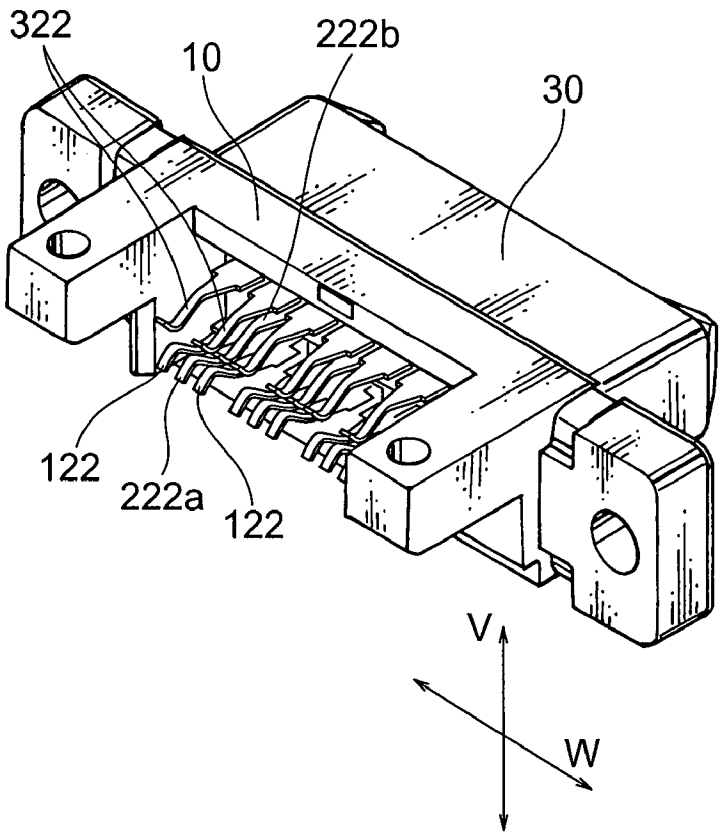
FIGS. 1A and 1B are perspective views, seen from the upper right front and the upper left rear, respectively, illustrating an electrical connector according to an embodiment of this invention.
Figure 1A:
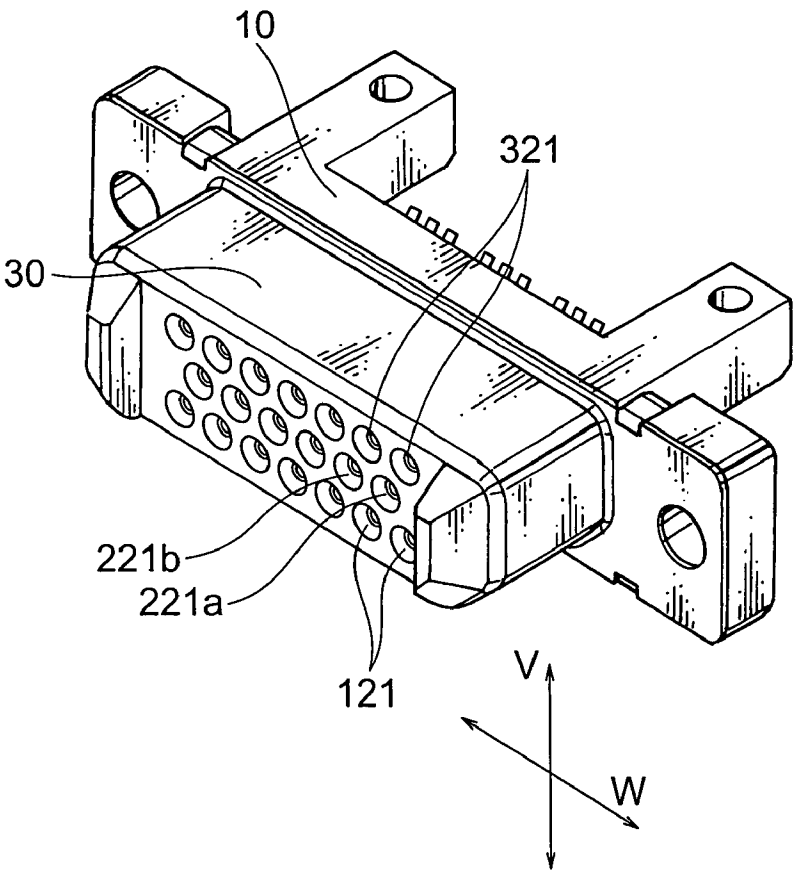
Figure 2A:
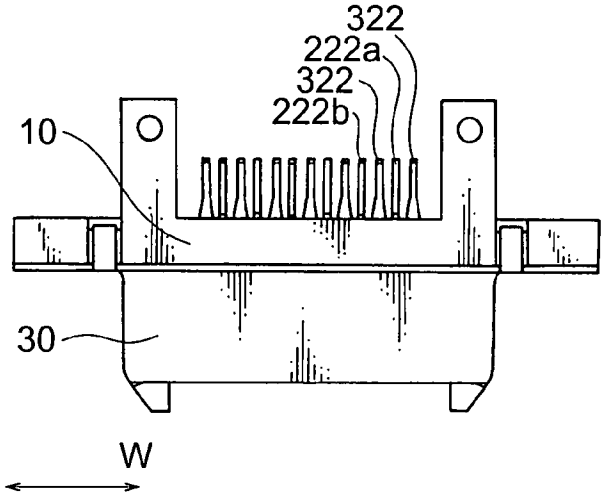
FIGS. 2A, 2B, 2C, and 2D are a top view, a front view, a rear view, and a right side view, respectively, illustrating the electrical connector illustrated in FIGS. 1A and 1B.
Figure 2B:
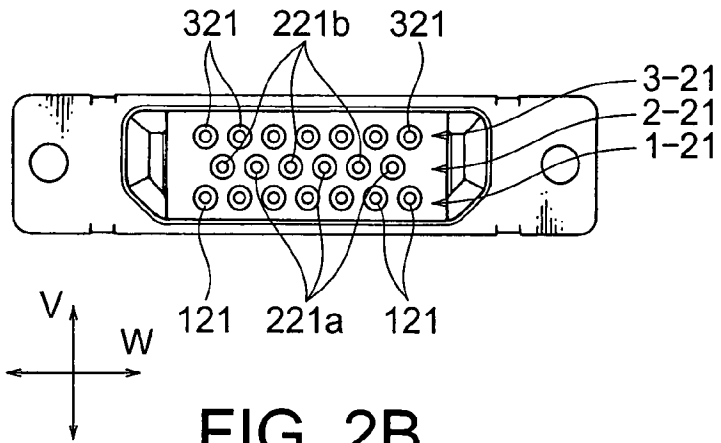
Figure 2C:
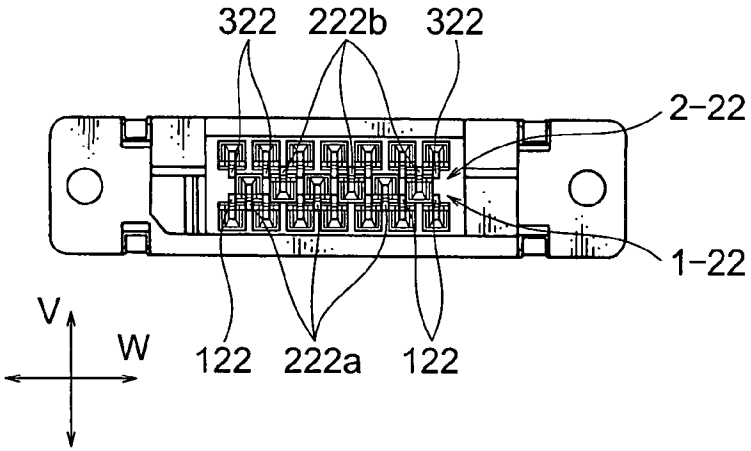
Figure 2D:
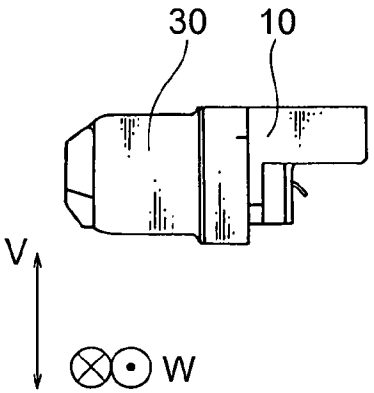
Figure 3:
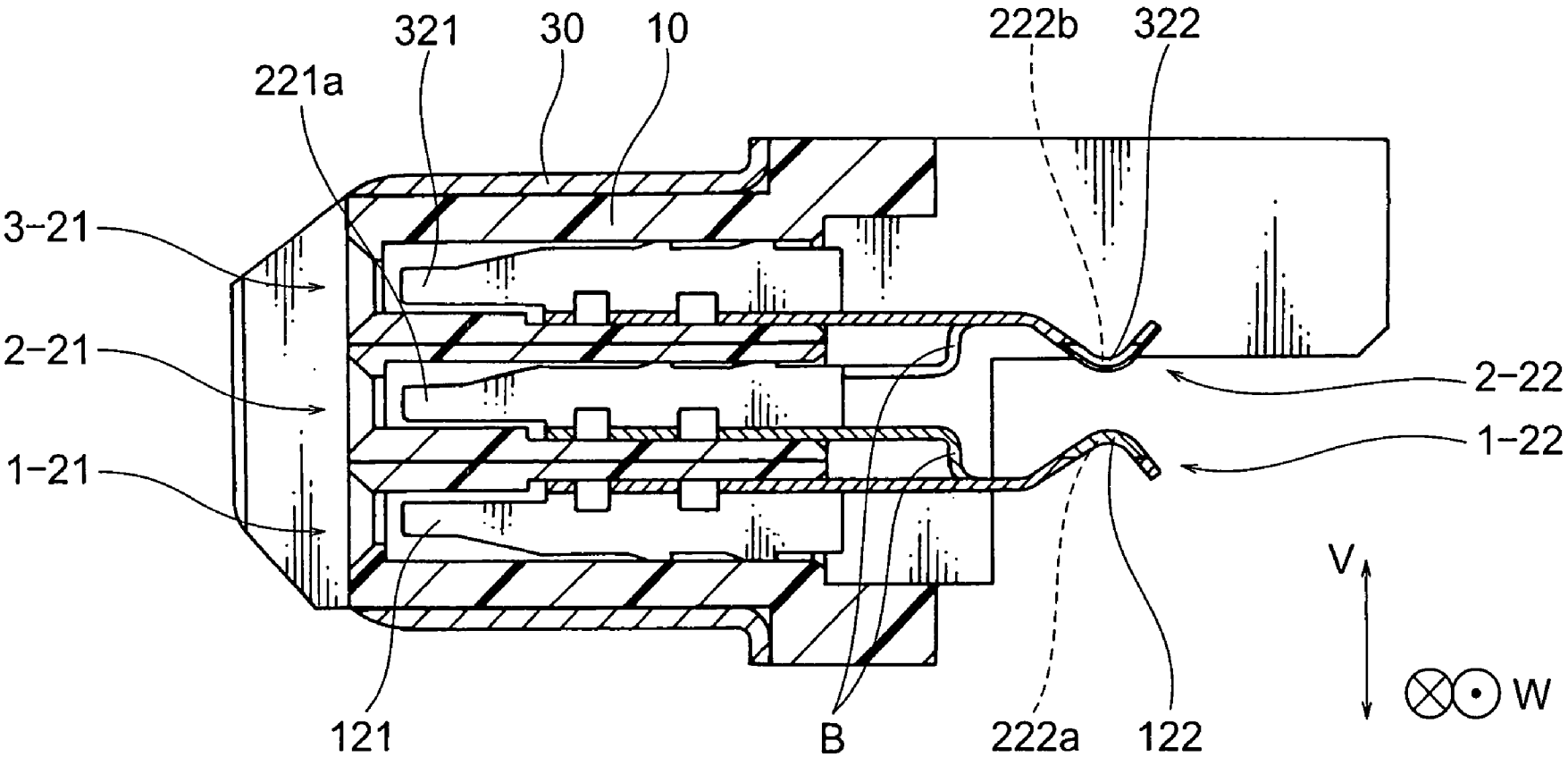
FIG. 3 is a sectional view of the electrical connector illustrated in FIGS. 1A and 1B.

In each of these six contacts, a connecting portion between the contact portion and the terminal portion is bent into a crank shape as indicated by symbol B in FIG. 3.

As described above, in this embodiment, the terminal portions 222*a* of the contacts having the contact portions 221*a* belonging to the second contact portion tier 2-21 are arranged in the first terminal portion tier 1-22, while, the terminal portions 222*b* of the contacts having the contact portions 221*b* likewise belonging to the second contact portion tier 2-21 are arranged in the second terminal portion tier 2-22.

Consequently, although the present electrical connector has the contacts whose contact portions are arranged in the odd number of contact portion tiers, the terminal portions thereof are allocated to the two terminal portion tiers in a balanced manner. Therefore, the occupation space is small and there is no positinal deviation during mounting operation on a connection object or no generation of unwanted stress after the mounting thereon.

The first and second terminal portion tiers 1-22 and 2-22 are respectively soldered to the pads or lands on first and second plate surfaces of the printed circuit board 500. Particularly, the contacts of the present electrical connector have elasticity and, therefore, before the electrical connector is soldered to the printed circuit board 500, the first and second terminal portion tiers 1-22 and 2-22 are respectively pressed against the first and second plate surfaces so that the printed circuit board 500 is elastically held between the first and second terminal portion tiers 1-22 and 2-22 in the thickness direction thereof.

Accordingly, the present electrical connector can be temporarily fixed to the printed circuit board 500 in a stable manner before being fixedly connected thereto.

With respect to the (n−m)-th (m is an integer of 1 or more and less than n) contact portion tier and the (n+m)-th contact portion tier forming a pair of tiers located in line symmetry with respect to the middle contact portion tier, the contacts having the contact portions 121 belonging to the (n−m)-th contact portion tier, i.e. the first contact portion tier 1-21 in this embodiment, and the contacts having the contact portions 321 belonging to the (n+m)-th contact portion tier, i.e. the third contact portion tier 3-21 in this embodiment, that is, the 14 contacts in total, all are same in shape. The contacts having the contact portions 121 and the contacts having the contact portions 321 are incorporated in the electrical connector in postures with their upper and lower sides reversed from each other with respect to the vertical direction V (vertical direction in FIG. 3).

Further, the six contacts in total having the contact portions 221*a* and 221*b* belonging to the (2n/2)-th contact portion tier being the middle contact portion tier, i.e. the second contact portion tier 2-21 in this embodiment, all are same in shape. The contacts having the contact portions 221*a* are incorporated in the same posture as that of the contacts having the contact portions 121, while, the contacts having the contact portions 221*b* are incorporated in the same posture as that of the contacts having the contact portions 321. Therefore, the contacts having the contact portions 221*a* and the contacts having the contact portions 221*b* are incorporated in postures with their upper and lower sides reversed from each other with respect to the vertical direction V (vertical direction in FIG. 3).

As described above, in the present electrical connector, the contacts having the contact portions 221*a* and 221*b* belonging to the second contact portion tier 2-21 all are same in shape. Therefore, in manufacturing the contacts of all the tiers of the present electrical connector, it is sufficient to prepare metal dies with two kinds of shapes for the above 14 contacts and the above six contacts.

Although this invention has been described in conjunction with the preferred embodiment thereof, this invention may be modified in various other manners within the scope of this invention. For example, the number of tiers of contact portions of contacts is not limited to three, but may be five, seven, or the like as long as it is an odd number.

What is claimed is:

1. An electrical connector comprising an insulator and a plurality of contacts arranged in line in a width direction of said insulator;

wherein said contacts have a contact portion adapted to be detachably connected to a first connection object and a terminal portion adapted to be fixedly connected to a second connection object, respectively;

said contact portions of said contacts are arranged in first, second, and third contact portion tiers superposed in a vertical direction perpendicular to the width direction of said insulator;

said terminal portions of the contacts having the contact portions belonging to the first contact portion tier is arranged in a first terminal portion tier of the first and second terminal portion tiers superposed in the vertical direction of said insulator;

said terminal portions of the contacts having the contact portions belonging to the third contact portion tier is arranged in said second terminal portion tier; and said terminal portions of the contacts having the contact portions belonging to the second contact portion tier are arranged so as to be alternately allocated to said first terminal portion tier and said second terminal portion tier.

2. The electrical connector according to claim 1, wherein said contacts having the contact portions belonging to the first contact portion tier and said contacts having the contact portions belonging to the third contact portion tier are same in shape; and said contacts having the contact portions belonging to the second contact portion tier are same in shape.

3. The electrical connector according to claim 1, wherein said second connection object has a plate-like shape, and said first and said second terminal portion tiers are fixedly connected to first and second plate surfaces of said second connection object, respectively.

4. The electrical connector according to claim 3, wherein said contacts have elasticity, and said first and second terminal portion tiers press against said first and said second plate surfaces of said second connection object, respectively, so as to hold therebetween said second connection object in said vertical direction.

* * * * *